US009835008B2

(12) United States Patent
Rogers et al.

(10) Patent No.: US 9,835,008 B2
(45) Date of Patent: Dec. 5, 2017

(54) METHOD AND APPARATUS FOR RETAINING WEIGHTED FLUID IN A TUBULAR SECTION

(71) Applicant: Halliburton Energy Services, Inc., Houston, TX (US)

(72) Inventors: Henry Eugene Rogers, Duncan, OK (US); Earl Don Webb, Wilson, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/104,481

(22) PCT Filed: Jan. 15, 2014

(86) PCT No.: PCT/US2014/011666
§ 371 (c)(1),
(2) Date: Jun. 14, 2016

(87) PCT Pub. No.: WO2015/108515
PCT Pub. Date: Jul. 23, 2015

(65) Prior Publication Data

US 2016/0312576 A1 Oct. 27, 2016

(51) Int. Cl.

| | |
|---|---|
| ***E21B 34/00*** | (2006.01) |
| ***E21B 34/06*** | (2006.01) |
| ***E21B 21/10*** | (2006.01) |
| ***E21B 19/00*** | (2006.01) |

(52) U.S. Cl.
CPC ..... *E21B 34/00* (2013.01); *E21B 19/002* (2013.01); *E21B 21/10* (2013.01); *E21B 34/06* (2013.01)

(58) Field of Classification Search
CPC ..... E21B 19/002; E21B 21/10; E21B 34/00; E21B 34/06
See application file for complete search history.

(56) References Cited

U.S. PATENT DOCUMENTS

| | | | | | |
|---|---|---|---|---|---|
| 1,811,885 | A | * | 6/1931 | Hill | E21B 21/10 166/327 |
| 2,698,054 | A | * | 12/1954 | Brown | E21B 21/10 137/493.9 |
| 3,086,591 | A | * | 4/1963 | Sexton | E21B 33/14 166/151 |
| 3,419,040 | A | * | 12/1968 | Thibodeaux | E21B 21/10 137/515.7 |
| 3,776,250 | A | | 12/1973 | Knox | |

(Continued)

OTHER PUBLICATIONS

International Search Report and Written Opinion in priority Application PCT/US2014/011666 dated Oct. 21, 2014.

(Continued)

*Primary Examiner* — Matthew R Buck
(74) *Attorney, Agent, or Firm* — McAfee & Taft

(57) ABSTRACT

A floating apparatus for use in a casing string and especially for use in offshore casing operations. The apparatus includes a valve configured such that, when there is a pressure differential across the valve below a predetermined mid-pressure threshold, the valve prevents fluid flow and, when the pressure differential exceeds a predetermined high-pressure threshold, said valve non-resiliently allows fluid flow across the valve.

19 Claims, 6 Drawing Sheets

(56) References Cited

U.S. PATENT DOCUMENTS

| | | | | | |
|---|---|---|---|---|---|
| 3,987,848 | A * | 10/1976 | Canterbury | E21B 34/06 | 137/505.18 |
| 4,401,134 | A | 8/1983 | Dailey | | |
| 4,615,394 | A | 10/1986 | Kuhlman, Jr. | | |
| 4,624,316 | A | 11/1986 | Baldridge et al. | | |
| 4,712,619 | A | 12/1987 | Stepp et al. | | |
| 5,411,049 | A * | 5/1995 | Colvard | E21B 21/10 | 137/515.7 |
| 5,472,053 | A | 12/1995 | Sullaway et al. | | |
| 5,501,280 | A | 3/1996 | Brisco | | |
| 5,647,434 | A | 7/1997 | Sullaway et al. | | |
| 6,497,291 | B1 | 12/2002 | Szarka | | |
| 6,622,795 | B2 * | 9/2003 | Hebert | E21B 21/10 | 137/515.7 |
| 6,666,273 | B2 * | 12/2003 | Laurel | E21B 21/10 | 166/320 |
| 6,668,943 | B1 | 12/2003 | Maus et al. | | |
| 7,234,522 | B2 | 6/2007 | Johnson et al. | | |
| 7,617,879 | B2 | 11/2009 | Anderson et al. | | |
| 9,291,007 | B2 | 3/2016 | Darbe et al. | | |
| 2006/0011354 | A1 | 1/2006 | Logiudice et al. | | |
| 2007/0095533 | A1 | 5/2007 | Rogers et al. | | |
| 2012/0273210 | A1 | 11/2012 | Arizmendi, Jr. et al. | | |
| 2013/0264069 | A1 | 10/2013 | Williamson, Jr. | | |

OTHER PUBLICATIONS

Halliburton leaflet titled, Super Seal II Float Shoe Nose Options, Halliburton Energy Services, Inc., 2006.

* cited by examiner

METHOD AND APPARATUS FOR RETAINING WEIGHTED FLUID IN A TUBULAR SECTION

FIELD OF THE INVENTION

This disclosure relates generally to offshore well drilling operations. More particularly, the invention pertains to installing a well casing into an offshore subsea well using a full column of weighted fluid inside a casing. Specifically, the disclosure relates to a high pressure opening valve assembly designed to be utilized with a full column of weighted fluid inside a casing.

BACKGROUND

Typically, after a well for the production of oil and/or gas has been drilled, casing will be lowered into and cemented in the well. During cementing, cement is forced down the bore of the casing, through an aperture in the guide shoe at the bottom of the casing, and up the annulus surrounding the casing and between the casing and the wellbore to the desired level. One or more valves, commonly termed float valves, are installed in the casing to prevent back flow of the cement into the casing from the annulus if pressure in the casing is reduced. Such a float valve may be in the form of a collar or an integral part of the guide shoe. The closed float valve or valves also seal the bottom of the casing and prevent fluids in the wellbore from filling it when the casing is lowered into the wellbore.

Some offshore applications and in particular, shallow water applications, have a requirement to maintain a full column of weighted fluid (typically drilling fluid or drilling mud), inside the casing string while running it from the rig floor to the sea-floor and into the borehole in riserless applications. Running the casing string full aids in getting the casing to the borehole in a controlled manner, helps to prevent kick and minimizes fluid contamination of wellbore fluids in the well. Kick is a condition where there is an influx of formation fluids into the wellbore. It occurs because the hydrostatic pressure exerted by the column of fluid contained within the wellbore and the drilling riser is not great enough to overcome the pressure exerted by the fluids in the formation drilled. Weighted fluids, such as drilling fluids, are heavier or denser than sea water and exert sufficient pressure to prevent kick. However, a common problem with offshore applications is that, during lowering of the casing to the borehole, the pressure differential between the drilling mud in the casing and the sea water surrounding the casing causes premature actuation of the float valve and allows sea water to displace the drilling mud. The sea water, being less dense than the drilling mud, exerts less of a hydrostatic pressure and thus, can allow kick to occur.

Past solutions to this problem have focused on increasing the activation pressure for the float valve; however, such techniques have proven to be problematic and impractical. Accordingly, it would be advantageous to provide a solution to this problem that did not involve increasing the activation pressure of the float valve.

BRIEF DESCRIPTION OF THE DRAWINGS

FIG. 6 is a cross-sectional view of an alternative embodiment of a HOP nose suitable for use in the float apparatus.

DESCRIPTION OF THE PREFERRED EMBODIMENTS

Figure 1:
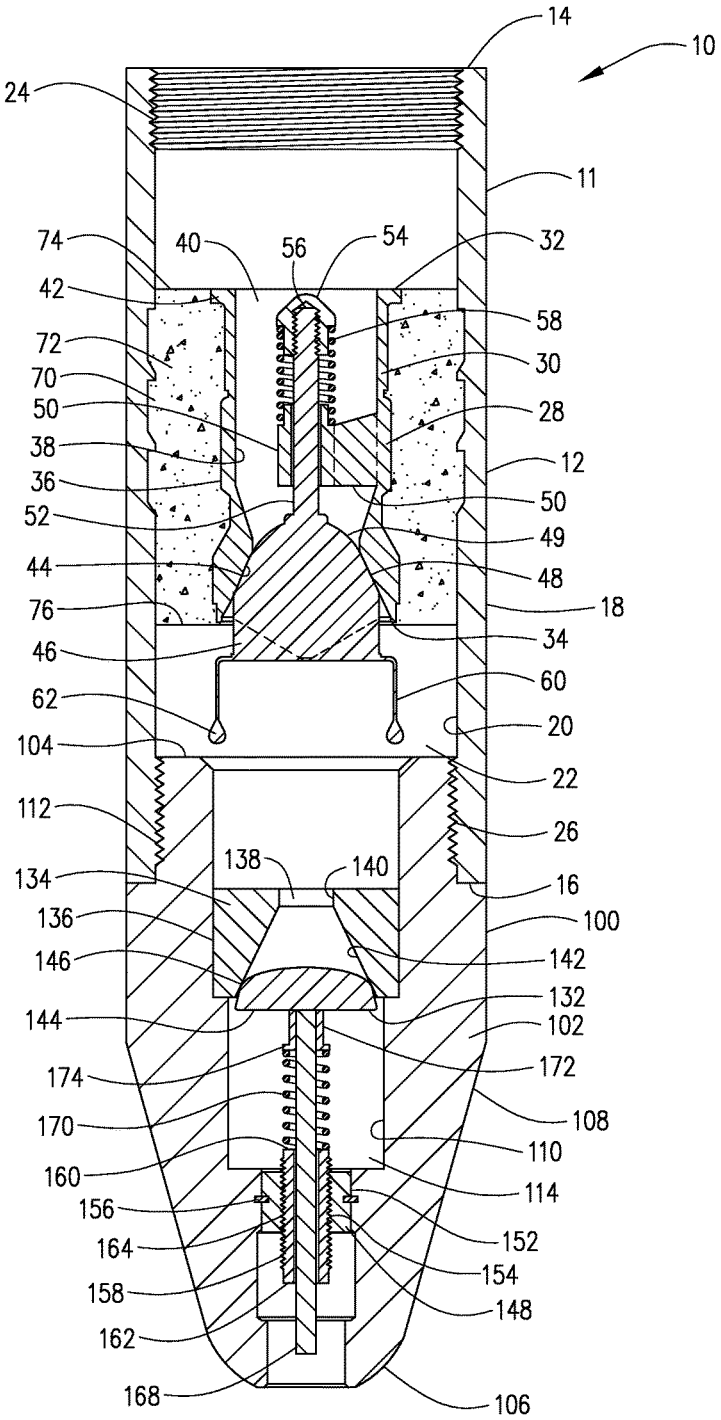
FIG. 1 is a cross-sectional view of a float apparatus having a float assembly and high opening pressure (HOP) nose in accordance with an embodiment.

Referring now to the drawings, and more particularly to FIG. 1, the floating apparatus of the present one embodiment is shown and generally designated by the numeral 10. Apparatus 10 includes a float assembly 11 and a high opening pressure (HOP) nose 100. It should be understood that HOP nose 100 can be used on a casing string separately from float assembly 11; however, benefits are obtained in using float assembly 11 with HOP nose 100, especially in offshore applications as hereinafter explained.

Focusing now on float assembly 11, the assembly includes an outer sleeve or outer case 12 which has a first or upper sleeve end 14 and a second or lower sleeve end 16, an outer surface 18 and an inner surface 20. In the embodiment shown in FIG. 1, the float assembly 11 includes an inner thread 24 at its upper end 14, and an inner thread 26 at its lower sleeve end 16, thereby configuring the float assembly 11 to be integrally attached to a casing string thereabove and HOP nose 100 therebelow. Inner surface 20 defines a central flow passage 22. As illustrated, central flow passage 22 extends from first sleeve end 14 to lower sleeve end 16 and thus, is in fluid flow communication with the interior of a casing string thereabove and with a HOP nose 100 therebelow.

A check valve 28 is disposed in outer case 12. Check valve 28 governs fluid flow through central flow passage 22. Check valve 28 includes a check valve housing 30 having an upper end 32, a lower end 34, an exterior surface 36 and an interior surface 38. Interior surface 38 defines a central chamber or bore 40 extending from upper end 32 to lower end 34. Check valve housing 30 may also include a radially outwardly extending lip 42 at its upper end 32. An annulus 70 is defined between check valve housing 30 and outer sleeve 12.

A check valve seat 44 is defined on interior surface 38. Check valve 28 further includes a check valve element 46 having a sealing surface 48, which sealingly engages check valve seat 44. A lip seal 49 may be defined on sealing surface 48. A check valve guide 50 disposed in check valve housing 30 slidingly receives a check valve stem 52, which extends upwardly from check valve element 46. A check valve cap 54 is attached to an upper end 56 of check valve stem 52. A check valve spring 58 is disposed about check valve stem 52 between check valve cap 54 and check valve guide 50. Check valve spring 58 biases check valve cap 54 upwardly thereby sealingly engaging check valve seat 44 and sealing surface 48 of check valve element 46.

The check valve 28 may further include an auto-fill strap 60 attached to the check valve element 46. Auto-fill strap 60 has a rounded end or bead 62 disposed at each end. Bead 62 may be placed between check valve seat 44 and sealing surface 48 prior to lowering the casing string into a well, thereby allowing fluid to flow through check valve 28 as apparatus 10 is lowered into the well. Once the casing is in place, fluid is pumped into the float equipment forcing check valve element 46 down and releasing the bead 62. Once fluid flow is stopped, check valve spring 58 will urge check valve stem 52 upwardly, so that sealing element 48 of check valve element 46 sealingly engages check valve seat 44. In off-shore applications, such as described below, this auto-fill function will generally not be utilized.

Looking again at annulus 70, a body portion 72 is disposed in annulus 70. The body portion 72 has an upper end 74, which terminates approximately at upper end 32 of check valve housing 30, and a lower end 76, which terminates approximately at lower end 34 of check valve housing 30. Body portion 72 is typically comprised of a high compressive strength cement.

Attached to and beneath float assembly 11 is HOP nose 100. The shoe includes an outer housing 102, which has a first housing end 104, a second housing end 106, an exterior face or surface 108 and an interior face or surface 110. Interior face 110 defines a central bore 114. In the embodiment shown in FIG. 1, the HOP nose 100 includes an exterior thread 112 at its first housing end 104, thereby configuring the HOP nose 100 to be integrally attached to float assembly 11. As illustrated, central bore 114 extends from first housing end 104 to second housing end 106 thus, is in fluid flow communication with the central flow passage 22 of float assembly 11 at first housing end 104 and forms an aperture in exterior face 108 at second housing end 106 therebelow. As can best be seen in FIG. 2, central bore 114 has an upper portion 116, a middle portion 118 and a lower portion 120 (also called stem bore 120). Upper portion 116 has an upper diameter 117, which is greater than middle diameter 119 of middle portion 118 thereby forming an upward facing shoulder referred to as upper interior shoulder 122. Middle diameter 119 is greater than lower diameter 121 of lower portion 120 and thereby forms an upward facing shoulder referred to as lower interior shoulder 124. Additionally, lower portion or stem bore 120 can be further defined into three portions: first portion 126, second portion 128 and third portion 130 having lower diameter 121, secondary diameter 129 and tertiary diameter 131, respectively. Secondary diameter 129 is greater than lower diameter 121 and, thus, forms a downward facing shoulder referred to as first stem bore shoulder 125. Secondary diameter 129 is greater than tertiary diameter 131 and thus, forms an upward facing shoulder referred to as second stem bore shoulder 127. Preferably, lower diameter 121 is greater than tertiary diameter 131. In another embodiment, the lower diameter 121 and secondary diameter 129 are equal and, thus, each have lower diameter 121 so that stem bore 120 has second stem bore shoulder 127; however, this embodiment does not provide for facilitating the movement of valve guide retainer 148 through stem bore 120 as explained below.

Figure 3:
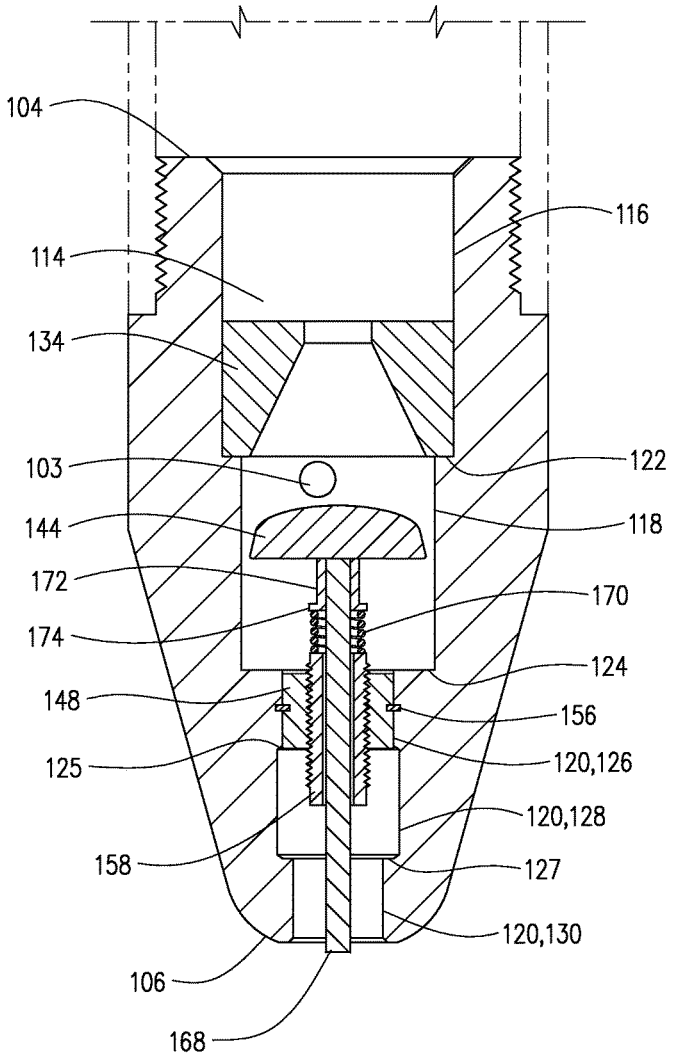
FIG. 3 is a cross-sectional view of the embodiment of FIG. 2 illustrated with the valve element resiliently disengaged from the valve seat.
Figure 4:
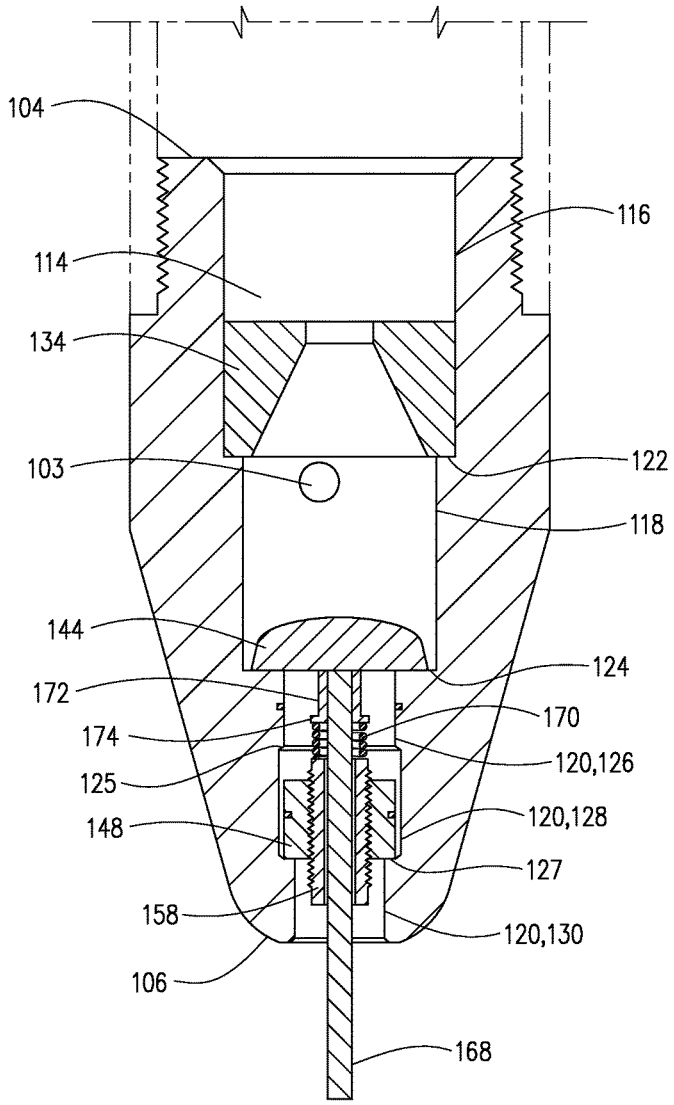
FIG. 4 is a cross-sectional view of the embodiment of FIG. 2 illustrated with the valve element non-resiliently disengaged from the valve seat when the differential pressure is above the predetermined high-pressure threshold.

As can best be seen from FIGS. 3 and 4, an aperture 103 extends from the exterior face 108 to interior face 110. Aperture 103 is located in middle portion 118 of central bore 114 and, thus, provides fluid flow communication between middle portion 118 and the outside of HOP nose 100. While only one such aperture 103 is illustrated, generally, there will be a plurality of such apertures located circumferentially about middle portion 118 of HOP nose 100.

Figure 2:
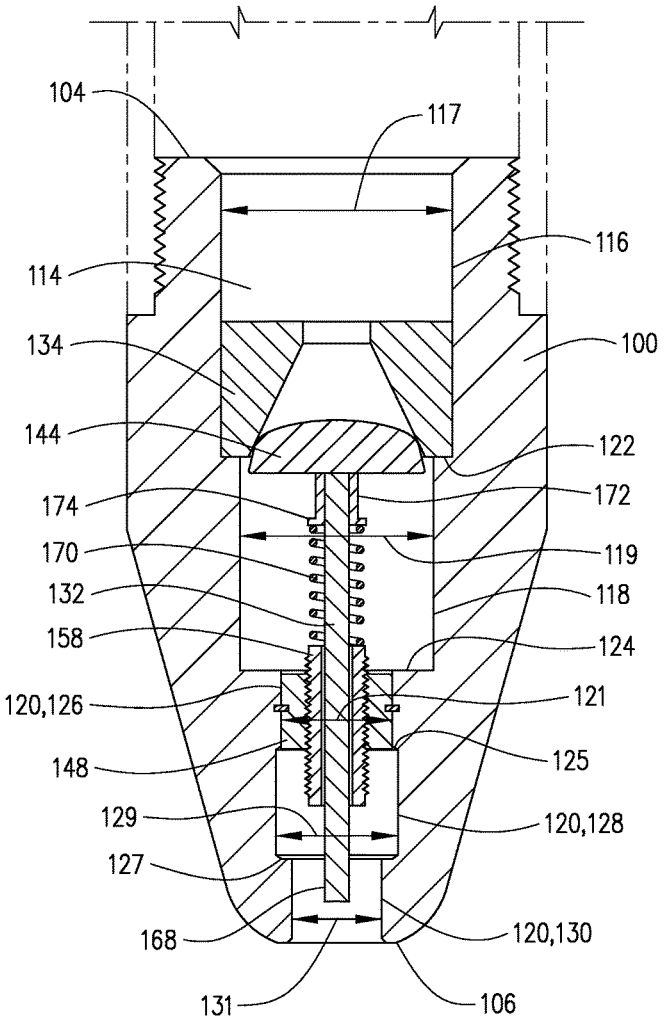
FIG. 2 is a cross-sectional view of a HOP nose in accordance with an embodiment. The HOP nose is illustrated with the valve element engaging the valve seat.

Looking now at FIGS. 1 and 2, a valve 132 is disposed in central bore 114 of outer housing 102. Outer housing 102 serves as the housing for the valve and as the outer case for HOP nose 100. Valve 132, as illustrated, is a check valve and governs fluid flow through central bore 114. A valve seat 134 is provided in upper portion 116 of central bore 114. Valve seat 134 is an insertable valve seat, which can be introduced through central bore 114 at first housing end 104. Valve seat 134 rests against upper interior shoulder 122, which holds it in place against downward movement in outer housing 102. During the lowering of the casing into the wellbore, valve seat 134 is held securely in place from upward movement by friction and drilling fluid pressure in the casing and floating apparatus 10. If additional restraint is required, pins or a retaining ring can be used to hold valve seat 134 in place.

Valve seat 134 has a cylindrical outer surface 136 to match and sealingly engage interior face 110. Valve seat 134 can be manufactured from any suitable material that is drillable and can withstand the pressures and temperatures encountered during the casing operation. The material can be a plastic, composite or a metal, such as aluminum. Additionally, o-rings (not shown) can be utilized between cylindrical outer surface 136 and interior face 110 to ensure a suitable sealing engagement is achieved. Valve seat 134 has a central aperture 138, which can have a cylindrical portion 140 and a conical portion 142.

Valve 132 further includes a valve element 144 having a sealing surface 146, which sealingly engages valve seat 134 at conical portion 142. A valve guide retainer 148 is disposed in first portion 126 of stem bore 120. Valve guide retainer 148 has an outer surface 152 and a threaded inner surface 154. As can be seen from the figures, valve guide retainer 148 has an outer diameter approximately equal to lower diameter 121 such that it fits within lower diameter 121 with outer surface 152 adjacent to the interior face 110 within first portion 126. Valve guide retainer 148 fits slidingly within first portion 126 but is shearingly attached to interior face 110 by shear pins 156 to prevent movement. The shearing attachment is configured to provide release of valve guide retainer 148 when the pressure above it (towards first housing end 104) exceeds a predetermined high-pressure threshold. Thus, before the pins are sheared, valve guide retainer 148 is fixedly attached to interior face 110 and held in place. When the pins are sheared, valve guide retainer 148 can move downwardly (towards second housing end 106) through stem bore 120.

A valve guide 158 is disposed in valve guide retainer 148. Valve guide 158 has a first end 160, a second end 162 and a threaded outer surface 164. Threaded outer surface 164 is threadedly engaged with threaded inner surface 154 of valve guide retainer 148. The threading engagement allows valve guide 158 to be rotated about its longitudinal axis and thereby move towards first housing end 104 (inwardly) or towards second housing end 106 (outwardly). Valve guide 158 slidingly receives a valve stem 168, which extends downwardly (towards second housing end 106) from valve element 144. A valve sleeve 172 is fixedly mounted on valve stem 168 adjacent to valve element 144. Stem sleeve 172 has lip 174. A valve spring 170 is disposed about valve stem 168 between lip 174 and first end 160 of valve guide 158. Valve spring 170 biases valve element 144 upwardly towards valve seat 134 thereby sealingly engaging valve seat 134 and sealing surface 146 of valve element 144. In an alternative embodiment illustrated in FIG. 6, valve spring 170 is disposed about valve stem 168 between valve element 144 and first end 160 of valve guide 158 without use of stem sleeve 172.

In use in offshore operations, i.e. where a wellbore is at the bottom of a body of water (typically salt water), the float apparatus is first attached to said casing string. While only the HOP nose described above can be attached to the casing string, generally the float assembly and HOP nose will be attached to the casing string. Use of both the float assembly and the HOP nose allows for advantageous control of fluid in the casing based on the differing pressures involved in lowering the casing, drilling fluid circulation processes and cementing processes.

If used, the check valve 28 in float assembly 11 will be activated or opened when the pressures differential across the check valve is above a predetermined low-pressure threshold. Because check valve 28 can only activate or open in one direction, the pressure must be greater on the first sleeve end 14 side of check valve 28 than on the second sleeve end 16 side of the check valve 28. In other words, the check valve will open when the pressure differential across the check valve is greater than the predetermined low-pressure threshold and the fluid pressure is greater in the central flow passage 22 at the first sleeve end 14 than in the central flow passage 22 at the second sleeve end 16. The predetermined low-pressure threshold will generally be greater than about 5 psi but lower than 50 psi and, typically, from 5 psi to 10 psi.

The valve 132 will be resiliently activated or opened when the pressures differential across valve 132 is above a predetermined mid-pressure threshold. Because valve 132 can only activate or open in one direction, the pressure must be greater on the first housing end 104 side of valve 132 than on the second housing end 106 side of valve 132. In other words, the valve will resiliently open or resiliently allow fluid flow when the pressure differential across the valve is greater than the predetermined mid-pressure threshold and the fluid pressure is greater in the central bore 114 at the first housing end 104 than in the central bore 114 at the second housing end 106. The predetermined mid-pressure threshold will be greater than the predetermined low-pressure threshold and thus, generally greater than 10 psi. More typically, the predetermined low-pressure threshold can be from about 50 psi to about 150psi, but can be from 50 psi to 100 psi, can be from 100 psi to 150 psi and, typically, can be from 75 psi to 125 psi.

Additionally, because valve guide retainer 132 is shearingly attached to outer housing 102, valve 132 will be non-resiliently activated or opened when the pressures differential across the check valve is above a predetermined high-pressure threshold. The predetermined high-pressure threshold will be greater than the predetermined mid-pressure threshold and thus, with generally be greater than about 150 psi. More typically, the predetermined high-pressure threshold can be greater than about 200 psi and can be greater than 250 psi. Although thresholds are indicated above, generally the basic requirement is that the predetermined low-pressure threshold is lower than either the predetermined mid-pressure threshold or the predetermined high-pressure threshold. Generally, the predetermined mid-pressure threshold is lower than the predetermined high-pressure threshold; however, it is within the scope of the invention that the predetermined mid-pressure threshold not be utilized, i.e. that valve 132 not have a resiliently open mode or that the predetermined mid-pressure threshold be set higher or equal to the predetermined high-pressure threshold. If the predetermined mid-pressure threshold is not utilized, then valve 132 will only open non-resiliently. As used herein, "resiliently open", "resiliently activate", "resiliently allow flow" and similar terms refers to a valve opening and allowing flow in a resilient or elastic manner so that if the pressure differential is reduced the valve will close and prevent flow through the valve. As used herein, "non-resiliently open", "non-resiliently activate", "non-resiliently allow flow" and similar terms refer to a valve opening and allowing flow in a non-resilient or inelastic manner so that if the pressure differential is reduced the valve will not close and prevent flow through the valve. In other words, when valve 132 resiliently allows flow, it can close and open repeatedly as the pressure differently fluctuates around the predetermined mid-pressure threshold; however, when valve 132 non-resiliently allows flow, it will open when the pressure differential exceeds the high-pressure threshold but will not thereafter close if the pressure differential drops below the high-pressure threshold.

As will be understood from the above, the HOP nose contains a one-way check valve that will retain fluid inside the casing at the elevated fluid pressure within a casing string caused by maintaining a full column of weighted fluid (typically drilling fluid or drilling mud), inside the casing string while running it from the rig floor to the sea-floor and into the borehole in riserless applications. The predetermined mid-pressure threshold and/or predetermined high-pressure threshold support a specific predetermined differential pressure caused by the fluid pressure within the casing being greater than the fluid pressure outside the casing. Additionally as explained below, the one-way check valve of the HOP nose can be adjusted to support various hydrostatic forces resulting from fluid inside the casing; that is, the specific predetermine differential pressure supported can be adjusted in accordance to the specific conditions encountered.

Prior to lowering the casing string into the well, valve 132 can be adjusted to change the predetermined mid-pressure threshold. Valve guide 158 can be turned so that it is moved inward (toward first housing end 104) or outward (toward second housing end 106) because of its threaded engagement with valve guide retainer 148. Moving valve guide 158 inward increases the compression of valve spring 170 thereby increasing the predetermined mid-pressure threshold. Moving valve guide 158 outward decreases the compression of valve spring 170 thereby decreasing the predetermined mid-pressure threshold.

The casing string is then lowered through the water and into the wellbore. During the lowering of the casing string the casing is kept full of a weighted fluid. Generally, the weighted fluid is introduced into the casing as it is lowered. Typically, the weighted fluid is a drilling fluid or drilling mud. The density of the weighted fluid is greater than the density of the surrounding water, because of this, in offshore, check valve 28 can be prematurely opened due to the weight or fluid pressure of the weighted fluid. When this happens the weighted fluid can be displaced by water in the casing. Valve 132 prevents this since it opens at a higher pressure differential than check valve 28.

After the casing string is lowered into place in the wellbore, well fluid can be circulated within the casing and wellbore by increasing the fluid pressure of the weighted fluid so that the pressure differential across valve 132 exceeds the predetermined mid-pressure threshold and thereby allowing resilient fluid flow through valve 132. The fluid flowing through valve 132 can flow into the borehole through aperture 103, as illustrated in FIG. 3.

During such resilient fluid flow valve, the increased pressure in the weighted fluid overcomes the biasing of valve spring 170 so that valve element 144 is moved toward second housing end 106 and, hence, disengaged from valve seat 134. Valve spring 170 is thereby compressed between valve element 144 and valve guide 158 or, if stem sleeve 172 is used, between lip 174 and valve guide 158. Valve guide retainer 148 remains attached to interior face 110 of outer housing 102. If the pressure is subsequently reduced below the predetermined mid-pressure threshold, the biasing of valve spring 170 is no longer overcome and valve element 144 returns to engage valve seat 134.

Figure 5:
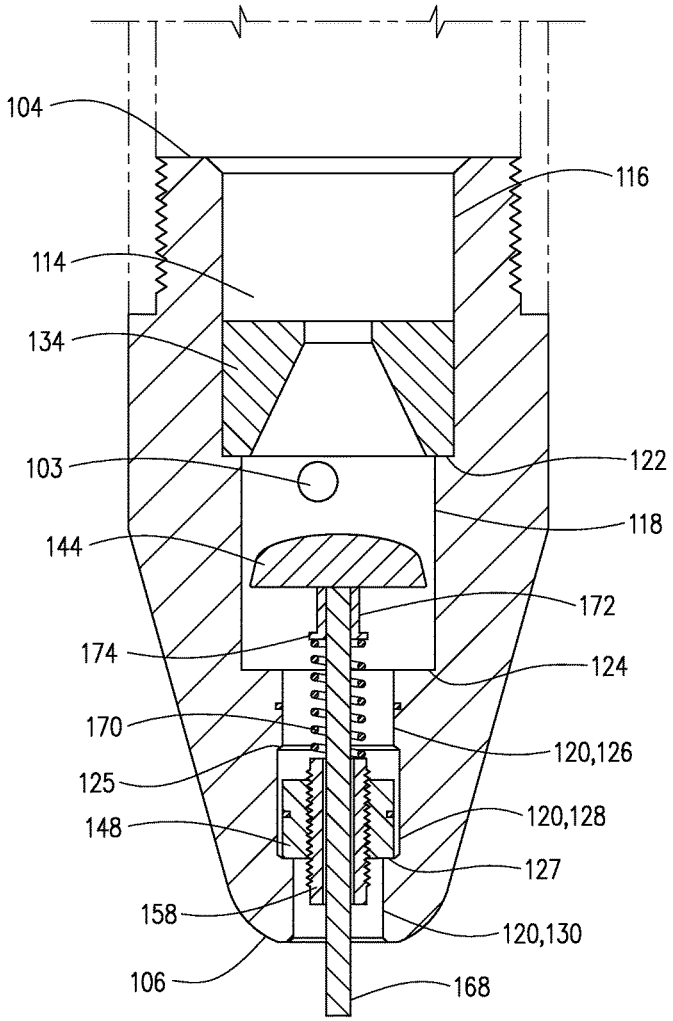
FIG. 5 is a cross-sectional view of the embodiment of FIG. 2 illustrated with the valve element non-resiliently disengaged from the valve seat when the differential pressure is below the predetermined high-pressure threshold.
Figure 5:
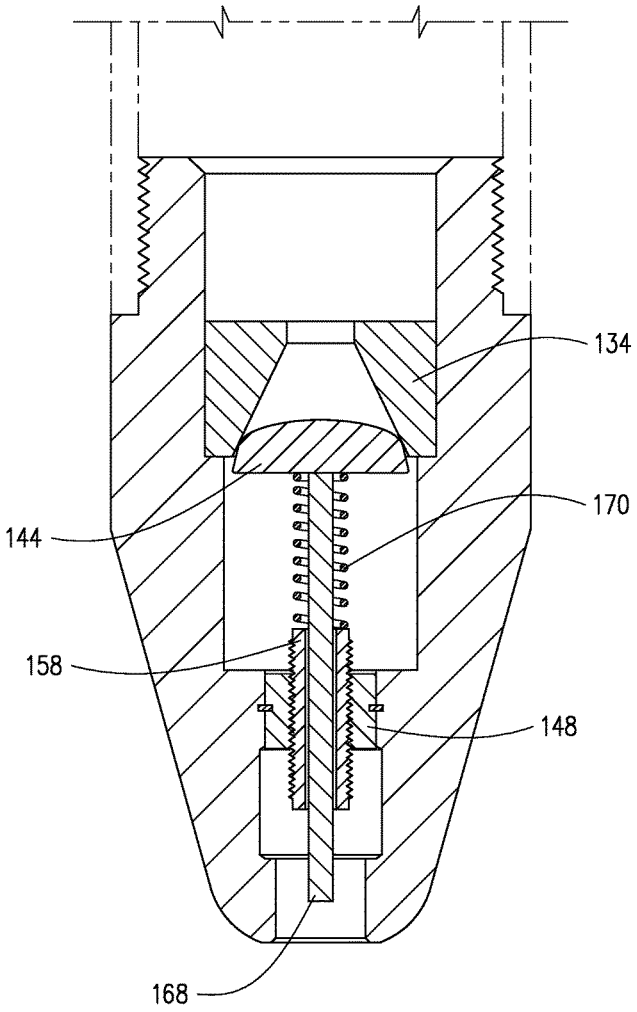

When use of valve 132 is no longer needed or desired, such as during cementing of the casing, the pressure of the weighted fluid can be increased so that the pressure differential across valve 132 exceeds the predetermined high-pressure threshold and thereby allowing non-resilient fluid flow through valve 132. During such non-resilient fluid flow valve, as the pressure increases so that the pressure differential is between the predetermined mid-pressure threshold and the predetermined high-pressure threshold, the increased pressure in the weighted fluid overcomes the biasing of valve spring 170 so that valve element 144 is moved toward second housing end 106 and, hence, disengaged from valve seat 134. Valve spring 170 is thereby compressed, as described above, and valve guide retainer 148 remains attached to interior face 110. As the pressure differential exceeds the predetermined high-pressure threshold, shear pins 156 shear and release valve guide retainer 148 so that it moves toward second housing end 106. As it passes through second portion 128 of stem bore 120 the increased diameter of second portion 128 facilitates movement by reducing friction between the outer surface 152 of valve guide retainer 148 and interior face 110. Valve guide retainer 148 next encounters second stem bore shoulder 127, which stops its movement through stem bore 120 as illustrated in FIG. 4. Valve guide retainer 148 has a diameter greater than tertiary diameter 131; thus, it can not pass into third portion 130 of stem bore 120 but is stopped by second stem bore shoulder 127. When the pressure differential is above the predetermined high-pressure threshold valve element 144 can be pushed down into contact with lower interior shoulder 124 as illustrated in FIG. 4. Because valve 132 is now non-resiliently open, it is effectively inoperable and, if the pressure differential is subsequently reduced below the predetermined high-pressure threshold or the predetermined mid-pressure threshold, valve element 144 will not return to engage valve seat 134, as illustrated in FIG. 5.

At this point, wellbore operations are controlled by check valve 28. Cement can be flowed down and out the lower end of the casing string. The cement fills an annulus between the outer surface of the casing string and the wellbore, thus cementing the casing in place. Next a displacement fluid is pumped down the casing string to move all the cement through check valve 28 and into the annulus between the outer surface of the casing string and the wellbore. After displacement operations are completed, the casing is filled with displacement fluid and cement is located in the annular space between the casing and the wellbore. At which point, the surface pressure is released such that pressure above check valve 28 is less than the pressure below check valve 28 and check valve 28 closes; that is check valve element 46 comes into sealing contact with check valve seat 44. Thus, check valve 28 holds the cement in place by creating a barrier for holding differential pressure.

In accordance with the above description, several specific embodiments will now be described. In one embodiment there is provide a HOP assembly for a fluid filled casing string. The HOP assembly comprises a housing configured to attach to the casing string. The housing contains an adjustable one-way check valve. Hydrostatic forces resulting from fluid inside the casing string creates a pressure differential across the adjustable one-way check valve. The adjustable one-way check valve supports the hydrostatic forces such that it remains closed up to a first predetermined pressure differential so as to retain the casing string in a fluid filled sate. The one-way check valve is adjustable such that the first predetermined pressure differential can be increased or decreased.

Additionally, the adjustable one-way check valve can non-re-resiliently allow fluid flow when a second predetermined pressure differential is exceeded. The second predetermined pressure differential being equal to or greater than the first predetermined pressure differential.

Further, the second predetermined pressure differential can be greater than the first predetermined pressure differential and, when the pressure differential is between the first predetermined pressure differential and the second predetermined pressure differential, the adjustable one-way check valve resiliently allows fluid flow.

In another embodiment there is provided a HOP nose for a casing string. The HOP nose comprising a housing and a valve positioned within the housing. The housing has a first housing end configured for attachment to a casing string; a second housing end; an exterior face extending from the first housing end to the second housing end; an interior face extending from the first housing end to the second housing end and defining a central bore; and an aperture extending from the exterior face to the interior face. The valve is positioned in the bore. The valve is configured such that, when there is a pressure differential between the first housing end and the aperture below a predetermined mid-pressure threshold, the valve element prevents fluid flow between the first housing end and the aperture. The valve is further configured such that, when the pressure differential exceeds a predetermined high-pressure threshold, the valve non-resiliently allows fluid flow from the first housing end to the aperture.

In a first application of the above embodiment, the predetermined mid-pressure threshold can be equal to the predetermined high-pressure threshold. In a second application of the above embodiment, the predetermined mid-pressure threshold is less than the predetermined high-pressure threshold. In this second application, when the pressure differential is from the predetermined mid-pressure threshold to the predetermined high-pressure threshold, the valve resiliently allows fluid flow from the first housing end to the aperture.

In a further embodiment, the valve can comprise a valve seat, a valve element, a valve guide retainer, a valve guide, a valve stem and a spring. The valve seat can be located in the central bore. The valve element can have a sealing surface sealingly engageable with the valve seat. The valve guide retainer can be attached to the housing and have an interior face defining a retainer passage. The valve guide can have a stem passage there through. The valve guide extending through the retainer passage and attached to the interior face of the valve guide retainer. The valve stem can extend from the valve element and through the valve guide with the valve stem being slidably received through the valve guide. A spring can be between the valve element and valve guide, and provide a biasing force such that the valve element sealingly engages the valve seat until the pressure differential reaches the predetermined mid-pressure threshold.

Further, the valve element can sealing engage the valve seat when the pressure differential is below the predetermined mid-pressure threshold; resiliently disengages from the valve seat when the pressure differential is from the predetermined mid-pressure threshold to the predetermined high-pressure threshold and non-resiliently disengages from the valve seat when the pressure differential is above the predetermined high-pressure threshold. Also, the valve guide can be threadedly connected to the valve guide retainer such that turning the valve guide increases the biasing force exerted on the valve element and the valve guide and, thusly, increases the predetermined mid-pressure threshold. Additionally, the valve guide retainer can be shearingly attached to the housing such that when the pressure differential exceeds the predetermined high-pressure threshold, the valve guide retainer detaches from the housing.

In a further embodiment the first housing end of the HOP nose can be attached to a float assembly comprising an outer sleeve, a check valve and a body portion. The outer sleeve can have a first sleeve end configured to be connected to the well casing, a second sleeve end attached to the first end of the housing of the HOP nose, an outer surface and an inner surface, wherein the inner surface defines a central flow passage. The check valve can be disposed in the central flow passage. The check valve comprising a check valve housing having an interior surface defining a central chamber in fluid flow communication with the central flow passage and an exterior surface opposing the inner surface of the outer sleeve. The exterior surface and inner surface define an annulus between the valve housing and the outer sleeve. The body portion fixedly attached to the housing and the outer sleeve. The body portion fills the annulus.

In the float assembly, the check valve can further comprise a check valve seat, a check valve guide, a check valve element and a check valve stem. The check valve seat can be defined on the check valve housing. The check valve guide can be disposed in the central chamber of the check valve housing. The check valve element can have a sealing surface sealingly engageable with the check valve seat. The check valve stem can extend upwardly from the check valve element and be slidably received through the check valve guide.

In another embodiment there is provided a float apparatus comprising a float assembly and a HOP nose. The float assembly has an outer sleeve, a check valve and a body portion. The outer sleeve has a first sleeve end configured to be connected to the well casing, a second sleeve end, an outer surface and an inner surface. The inner surface defines a central flow passage. The check valve is disposed in the central flow passage. The check valve comprises a check valve housing. The check valve housing has an interior surface defining a central chamber in fluid flow communication with the central flow passage and an exterior surface opposing the inner surface of the outer sleeve. The exterior surface and inner surface define an annulus between the valve housing and the outer sleeve. When there is a first pressure differential between the first sleeve end and the second sleeve end less than a predetermined low-pressure threshold, the check valve prevents fluid flow through the central passage. When the first pressure differential is greater than the predetermined low-pressure threshold, the valve allows fluid flow through the central passage. The body portion is fixedly attached to the housing and the outer sleeve such that the body portion fills the annulus.

The float shoe has a housing and a valve positioned in the housing. The housing has a first housing end attached to the second sleeve end; a second housing end; an exterior face extending from the first housing end to the housing second end; an interior face extending from the first housing end to the second housing end and defining a central bore; and an aperture extending from the exterior face to the interior face. The valve is positioned in the bore. The valve is configured such that, when there is a second pressure differential between the first housing end and the second housing end below a predetermined mid-pressure threshold, the valve element prevents fluid flow between the first housing end and the aperture. The valve is further configured such that when the pressure differential exceeds the predetermined high-pressure threshold, the valve non-resiliently allows fluid flow from the first housing end to the aperture.

In yet another embodiment there is provided a method of placing a casing string having an interior into a wellbore at the bottom of a body of water. The method comprising:

(a) attaching a HOP nose to the casing string, the HOP nose having an interior and an aperture, which allows fluid flow communication between the interior of the HOP nose and the outside of the HOP nose;

(b) lowering the casing through the water and into the wellbore;

(c) introducing a fluid into the interior of the casing, the fluid having a fluid pressure;

(d) during the lower lowering step (b), preventing fluid flow communication between the interior of the casing and the aperture of the HOP nose when the fluid pressure is below a predetermined mid-pressure threshold;

(e) after the lowering of step (b), preventing fluid flow communication between the interior of the casing and the aperture of the HOP nose only when the fluid pressure is below a predetermined low-pressure threshold, wherein the predetermined low-pressure threshold is less than the predetermined mid-pressure threshold.

In the above method the density of the fluid can be less than the density of the water of the body of water. Further, fluid flow communication is controlled by a first check valve and a second check valve. The first check valve resiliently allowing fluid flow communication when the fluid pressure is at or above the predetermined low-pressure threshold and the second check valve resiliently allowing fluid flow communication when the fluid pressure is at or above the predetermined mid-pressure threshold.

The method can further comprise, after the lowering step (b), the step of disabling the second check valve such that it non-resiliently allows fluid flow communication above and below the predetermined mid-point threshold. Also, the step of disabling the second check valve can comprise increasing the fluid pressure to above a predetermined high-pressure threshold wherein the predetermined high-pressure threshold is greater than the predetermined mid-pressure threshold.

In the above description terms such as up, down, lower, upper, upward, downward and similar have been used to describe the placement or movement of elements. It should be understood that these terms are used in accordance with the typical orientation of a casing string; however, the invention is not limited to use in such an orientation but is applicable to use with other orientations. Also, it will be seen that the apparatus of the present invention and method of use of such an apparatus are well adapted to carry out the ends and advantages mentioned as well as those inherent therein. While the presently preferred embodiment of the invention has been shown for the purposes of this disclosure, numerous changes in the arrangement and construction of parts may be made by those skilled in the art. All such changes are encompassed within the scope and spirit of the dependent claims.

What is claimed is:

1. A high opening pressure (HOP) assembly for a fluid filled casing string comprising:

a housing configured to attach to said casing string wherein said housing contains an adjustable one-way check valve, wherein hydrostatic forces resulting from fluid inside said casing string creates a pressure differential across said adjustable one-way check valve and said adjustable one-way check valve supports said hydrostatic forces such that said adjustable one-way check valve prevents fluid flow up to a first predetermined pressure differential so as to retain said casing string in a fluid filled state and wherein said adjustable one-way check valve is adjustable such that said first predetermined pressure differential can be increased or decreased, and wherein said adjustable one-way check valve non-resiliently allows fluid flow when a second predetermined pressure differential is exceeded, wherein said second predetermined pressure differential is greater than said first predetermined pressure differential, and when said pressure differential is between said first predetermined pressure differential and said second predetermined pressure differential, said adjustable one-way check valve resiliently allows fluid flow.

2. The HOP assembly of claim 1, wherein said adjustable one-way check valve has a valve assembly which is shearingly attached to said housing such that when said pressure differential exceeds said second predetermined pressure differential, said valve assembly detaches from said housing so as to non-resiliently allow fluid flow when said second predetermined pressure differential is exceeded.

3. The HOP assembly of claim 2, further comprising a float check valve associated with said adjustable one-way check valve, wherein said hydrostatic forces create the pressure differential across said float check valve, and said float check valve supports said hydrostatic forces such that said float check valve prevents fluid flow across said float check valve up to a third predetermined pressure differential so as to retain said casing string in a fluid filled state, and wherein said third predetermined pressure differential is less than said first predetermined pressure differential and, when said pressure differential is above said third predetermined pressure differential, said float check valve resiliently allows fluid flow.

4. A high opening pressure (HOP) nose for a casing string, comprising:

a housing having a first housing end configured for attachment to said casing string; a second housing end; an exterior face extending from said first housing end to said second housing end; an interior face extending from said first housing end to said second housing end and defining a central bore; and an aperture extending from said exterior face to said interior face; and a valve positioned in said bore, said valve configured such that, when there is a pressure differential between said first housing end and said aperture below a predetermined mid-pressure threshold, said valve prevents fluid flow between said first housing end and said aperture, and when said pressure differential exceeds a predetermined high-pressure threshold, said valve non-resiliently allows fluid flow from said first housing end to said aperture.

5. The HOP nose of claim 4 wherein said predetermined mid-pressure threshold is equal to said predetermined high-pressure threshold.

6. The HOP nose of claim 4 wherein said predetermined mid-pressure threshold is less than said predetermined high-pressure threshold.

7. The HOP nose of claim 6 wherein, when said pressure differential is from said predetermined mid-pressure threshold to said predetermined high-pressure threshold, said valve resiliently allows fluid flow from said first housing end to said aperture.

8. The HOP nose of claim 4 wherein said first housing end of said housing is attached to a float assembly comprising:

an outer sleeve having a first sleeve end configured to be connected to said casing string, a second sleeve end connected to said first end of said housing, outer surface and an inner surface, wherein said inner surface defines a central flow passage;

a check valve disposed in said central flow passage, said check valve comprising a check valve housing having an interior surface defining a central chamber in fluid flow communication with said central flow passage and an exterior surface opposing said inner surface of said outer sleeve wherein said exterior surface and inner surface define an annulus between said valve housing and said outer sleeve; and a body portion fixedly attached to said housing and said outer sleeve such that said body portion fills said annulus.

9. The HOP nose of claim 8 wherein said valve further comprises:

a check valve seat defined on said check valve housing;

a check valve guide disposed in said central chamber of said check valve housing;

a check valve element having a sealing surface sealingly engageable with said check valve seat; and a check valve stem extending from said check valve element and slidably received through said check valve guide.

10. A high opening pressure (HOP) nose for a casing string, said HOP nose comprises:

a housing having a first housing end configured for attachment to said casing string; a second housing end; an exterior face extending from said first housing end to said second housing end; an interior face extending from said first housing end to said second housing end and defining a central bore; and an aperture extending from said exterior face to said interior face; and a valve positioned in said bore, said valve configured such that, when there is a pressure differential between said first housing end and said aperture below a predetermined mid-pressure threshold, said valve prevents fluid flow between said first housing end and said aperture, and when said pressure differential exceeds a predetermined high-pressure threshold, said valve non-resiliently allows fluid flow from said first housing end to said aperture, wherein said predetermined mid-pressure threshold is less than said predetermined high-pressure threshold, and when said pressure differential is from said predetermined mid-pressure threshold to said predetermined high-pressure threshold, said valve resiliently allows fluid flow from said first housing end to said aperture, and wherein said valve comprises:

a valve seat located in said central bore;

a valve element having a sealing surface sealingly engageable with said valve seat;

a valve guide retainer attached to said housing and having an interior face defining a retainer passage;

a valve guide having a stem passage there through, said valve guide extending through said retainer passage and attached to said interior face of said valve guide retainer;

a valve stem extending from said valve element and through said valve guide; said valve stem being slidably received through said valve guide; and a spring between said valve element and valve guide, and providing a biasing force such that said valve element sealingly engages said valve seat until said pressure differential reaches said predetermined mid-pressure threshold.

11. The HOP nose of claim 10 wherein said valve element sealingly engages said valve seat when said pressure differential is below said predetermined mid-pressure threshold; resiliently disengages from said valve seat when said pressure differential is from said predetermined mid-pressure threshold to said predetermined high-pressure threshold and non-resiliently disengages from said valve seat when said pressure differential is above said predetermined high-pressure threshold.

12. The HOP nose of claim 11 wherein said valve guide is threadedly connected to said valve guide retainer such that turning said valve guide increases said biasing force exerted on said valve element and said valve guide and, thusly, increases said predetermined mid-pressure threshold.

13. The HOP nose of claim 12 wherein said valve guide retainer is shearingly attached to said housing such that when said pressure differential exceeds said predetermined high-pressure threshold, said valve guide retainer detaches from said housing.

14. The HOP nose of claim 13 wherein said first housing end is attached to a float assembly comprising:

an outer sleeve having a first sleeve end configured to be connected to said casing string, a second sleeve end attached to said first end of said housing, an outer surface and an inner surface, wherein said inner surface defines a central flow passage;

a check valve disposed in said central flow passage, said check valve comprising a check valve housing having an interior surface defining a central chamber in fluid flow communication with said central flow passage and an exterior surface opposing said inner surface of said outer sleeve wherein said exterior surface and inner surface define an annulus between said valve housing and said outer sleeve; and a body portion fixedly attached to said housing and said outer sleeve, wherein said body portion fills said annulus.

15. The HOP nose of claim 14 wherein said check valve further comprises:

a check valve seat defined on said check valve housing;

a check valve guide disposed in said central chamber of said check valve housing;

a check valve element having a sealing surface sealingly engageable with said check valve seat; and a check valve stem extending upwardly from said check valve element and slidably received through said check valve guide.

16. A method of placing a casing string having an interior into a wellbore at the bottom of a body of water, the method comprising:

(a) attaching a high opening pressure (HOP) nose to said casing string, said HOP nose having an interior and an aperture, which allows fluid flow communication between said interior of said HOP nose and the outside of said HOP nose;

(b) lowering said casing string through said water and into said wellbore;

(c) introducing a fluid into said interior of said casing string, said fluid having a fluid pressure;

(d) during said lowering step (b), preventing fluid flow communication between said interior of said casing string and said aperture of said HOP nose when said fluid pressure is below a predetermined mid-pressure threshold; and (e) after said lowering of step (b), preventing fluid flow communication between said interior of said casing string and said aperture of said HOP nose only when said fluid pressure is below a predetermined low-pressure threshold, wherein said predetermined low-pressure threshold is less than said predetermined mid-pressure threshold;

wherein fluid flow communication is controlled by a first check valve and a second check valve with said first check valve resiliently allowing fluid flow communication when said fluid pressure is at or above said predetermined low-pressure threshold and said second check valve resiliently allowing fluid flow communication when said fluid pressure is at or above said predetermined mid-pressure threshold.

17. The method of claim 16 further comprising, after said lowering step (b), disabling said second check valve such that said second check valve non-resiliently allows fluid flow communication above and below said predetermined mid-point threshold.

18. The method of claim 17 wherein said step of disabling said second check valve comprises increasing said fluid pressure to above a predetermined high-pressure threshold wherein said predetermined high-pressure threshold is greater than said predetermined mid-pressure threshold.

19. The method of claim 18 wherein the density of said fluid is less than the density of the water of said body of water.

* * * * *